United States Patent [19]

Membrino

[11] 3,993,191

[45] Nov. 23, 1976

[54] DIVIDABLE TRANSPORT PALLET AND PACKAGE

[75] Inventor: John N. Membrino, Berwyn, Pa.

[73] Assignee: Scott Paper Company, Philadelphia, Pa.

[22] Filed: Apr. 7, 1975

[21] Appl. No.: 565,819

[52] U.S. Cl. ..... 206/386; 83/200.1; 206/498; 229/51 DB

[51] Int. Cl.[2] ..... B65D 19/06; B65D 5/54; B65D 17/20

[58] Field of Search ..... 206/386, 264, 498; 229/51 DB, 51 S, 15; 83/200.1

[56] References Cited

UNITED STATES PATENTS

| | | | |
|---|---|---|---|
| 2,935,187 | 5/1960 | Seidler | 206/264 |
| 3,248,037 | 4/1966 | Simkins | 229/15 |
| 3,659,707 | 5/1972 | Nilsson et al. | 229/51 DB |

*Primary Examiner*—William T. Dixson, Jr.
*Attorney, Agent, or Firm*—Bruce Hart; Martin L. Faigus; William J. Foley

[57] ABSTRACT

Disclosed is a dividable transport package consisting of two or more containers placed on a single pallet in side-by-side relationship on opposite sides of a vertical dividing plane. The pallet forms the bottom of the package and includes a continuous-plane platform of low tear strength material which supports all of the containers in the package. The pallet is encircled in each of the vertical dividing planes by a thin band of high tensile strength material which, upon being pulled through the pallet, divides the pallet to form two or more separate self-supporting, palletized packages. Also disclosed is a dividable pallet for supporting two or more objects.

10 Claims, 3 Drawing Figures

DIVIDABLE TRANSPORT PALLET AND PACKAGE

BACKGROUND OF THE INVENTION

1. Field of the Invention

The invention relates to new and useful improvements in warehousing and shipping pallets, and in particular, to an improved dividable pallet and palletized shipping and display package.

2. Description of the Prior Art

The typical distribution technique for getting merchandise such as grocery items from a manufacturer to the consumer is to transport the merchandise in shipping packages form the manufacturer's facilities to a central warehouse, from where they are distributed to the storerooms of retail stores. At the retail store, the packages are kept in the storeroom until there is need to replenish the merchandise on the shelves. At this time, an individual package is placed upon a hand truck and taken to the shelves where the merchandise is removed from the package and placed on the shelves for display and purchase by the consumers.

The typical distribution technique is not entirely satisfactory for a number of reasons. For example, it is desirable to transport large packages of merchandise to the retail store storeroom, but undesirable to transport large packages from the retail store storeroom to the shelves. The conflict is usually solved by repacking the merchandise in smaller packages either at the central warehouse or in the storeroom of the retail store. The disadvantage of the additional labor is obvious. A more satisfactory approach would be to provide a dividable transport package which can be initially transported as a large package and later divided into smaller packages. A further disadvantage to the typical distribution technique is the necessity to remove the merchandise by hand from the shipping package and place it upon the shelves. And a further disadvantage to the typical distribution technique is that modern transporting vehicles, such as fork lift trucks, require the packages to be supported by a rigid support structure, such as a pallet, which is usually so expensive that it must be returned to the manufacturer, requiring extra labor and expense.

These disadvantages have been at least partially avoided by a number of developments in the art. For example, dividable pallets are disclosed in U.S. Pat. Nos. 3,157,423; 3,650,224; and 3,659,707. Also, disposable pallets which need not be returned to the manufacturer are illustrated in U.S. Pat. No. 3,007,663. Shipping packages which can be divided into smaller packages in which the merchandise can be displayed and taken by the customer have also been developed, examples being disclosed in U.S. Pat. Nos. 2,297,982; 3,127,991; 3,139,979; and 3,653,495.

None of these prior art shipping packages entirely solve the problems existing in the typical distribution technique. For example, the dividable pallets of U.S. Pat. Nos. 3,157,423 3,650,224 are expensive and are not disposable. On the other hand, the disposable pellet of U.S. Pat. No. 3,007,663 is not dividable. Also, the dividable shipping/display packages of U.S. Pat. Nos. 2,297,982; 3,127,991; 3,139,979; and 3,653,495 are small packages incapable of being transported by modern transporting vehicles without being placed upon separate supporting structures. The dividable, disposable transport package disclosed in U.S. Pat. No. 3,659,707 appears to avoid many of the disadvantages described above, but its structure sacrifices strength by requiring the bottom portion to be slotted to enable the package to be divided. Furthermore, it appears to require special tools, such as a saw, for cutting the rims which interconnect the two halves of the tray if it is constructed with sufficient strength to be handled by modern transporting vehicles.

In view of the shortcomings of the prior art, it is an object of the invention to provide a dividable pallet and a dividable palletized package which can be disposed of after the merchandise has been removed from within it. It is a further object of the invention to provide a pallet and a palletized package which can be divided into two or more containers without the use of special tools.

SUMMARY OF THE INVENTION

The package of the invention is a dividable transport package which consists of at least two containers in side-by-side relationship on opposite sides of a vertical dividing plane, and a single pallet upon which the containers are secured to form the bottom of the package. The pallet of the invention comprises a continuous-plane platform of low tear strength material which supports all of the containers in the package and a thin band of high tensile strength material encircling the pallet in each of the vertical dividing planes for dividing the pallet upon pulling the band to form separate self-supporting palletized packages.

The invention permits transporting a large package of merchandise kept intact on a single integral pallet. At the same time, the package can be conveniently divided into two or more smaller containers which are also palletized for convenient transporting and are adaptable to display the merchandise. The containers as well as the pallet can be made from low cost material, such as corrugated board and kraft paper formed into a honeycomb structure, and therefore, are economical to dispose of rather than return to the manufacturer. No special tools are required for dividing the package, since any conventional tool, such as a claw hammer, meat hooks or other tools usually found in retail store storerooms can be used.

DESCRIPTION OF THE PREFERRED EMBODIMENTS OF THE INVENTION

Figure 1:
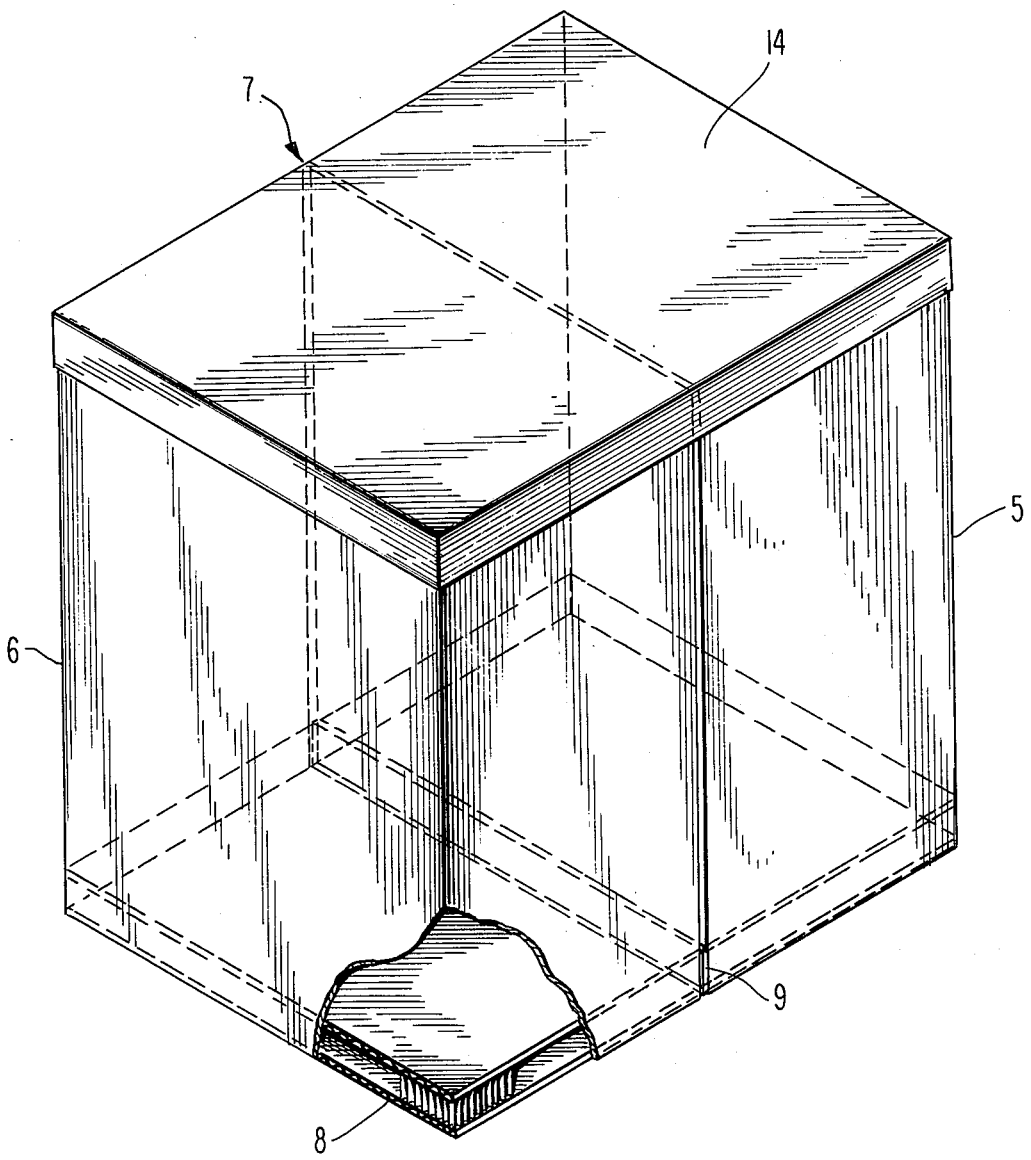
FIG. 1 is a perspective view of the dividable package of the invention with a portion broken away to illustrate the pallet construction.

The preferred package of the invention consists of two containers 5 and 6 in side-by-side relationship on opposite sides of a vertical dividing plane indicated generally by 7. The two containers 5 and 6 are secured to a single pallet 8 which forms the bottom of the package. A thin band 9 of high tensile strength material encircles the pallet in the vertical dividing plane 7. The band 9 is used to divide the pallet by pulling the band 9, thereby cutting the pallet 8 in two pieces. After the package is divided into its two containers 5 and 6, either or both of the containers 5 and 6 can be transported to the display area with a hand truck modified to include two fork-like prongs. The container can then have one wall removed to display the merchandise 10 within and to permit customers to remove the merchandise from the container.

Figure 3:
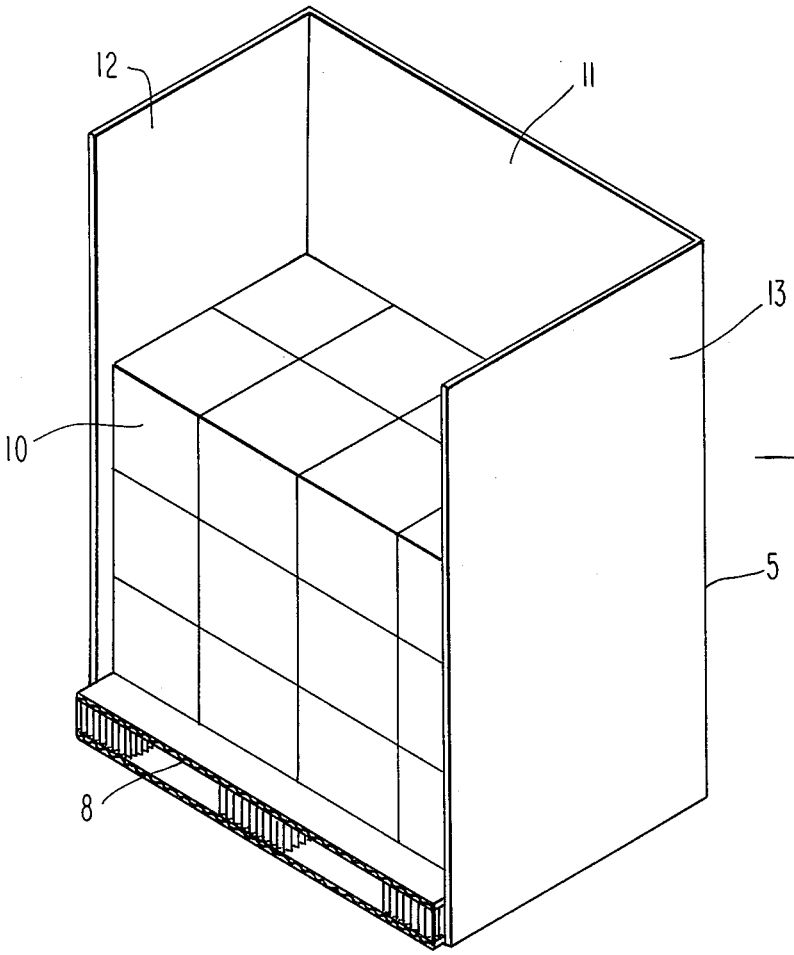
FIG. 3 is a perspective view of the package of the invention after it has been divided and with one wall of the container removed to display the merchandise within.

The preferred container is one formed by a conventional corrugated boxboard tube having a back wall 11, side walls 12 and 13 and a front wall (removed in FIG. 3 to display the merchandise 10). The back wall 11 and side walls 12 and 13 preferably extend down farther than the front wall to permit them to be secured to the edges of pallet 8 by such means as adhesive or staples. Thus, pallet 8 forms the bottom of both containers 5 and 6. A corrugated boxboard cap member 14 is placed over the tops of both containers 5 and 6 to form the top member of both containers 5 and 6 and to secure the top of the two containers together during shipment. An example of a cap member 14 is one constructed of conventional corrugated boxboard and have downwardly extending sides of about 7 inches. The front wall of each container 5 and 6 is preferably easily removable from the container to display the merchandise 10. It can consist of a corrugated boxboard sheet taped to the edges of side members 12 and 13, or it can be a continuation of the side walls 12 and 13 and having perforations along its edges for ease of removal, or it can use a combination of taped edges and perforations.

The dividable pallet 8 of the invention, which is used to form the bottom of the package of the invention, is made of low tear strength material which can be easily cut by the band 9, but at the same time has sufficient rigidity to provide a transportable pallet for the package. The preferred pallet construction consists of a top sheet 15 of conventional corrugated boxboard spaced apart from a bottom sheet 16 of conventional corrugated boxboard by a plurality of kraft linerboard honeycomb or other low tear resistant spacers 17. The top sheet 15 forms a continuous-plane platform for supporting the containers. An example of a desirable pallet construction is one using 200 lb. test board for the top sheet 15 and for the bottom sheet 16. When constructed to be 48 inches × 40 inches in size, it will support loads of 500 lbs. and greater.

The spacers 17 are preferably about 2 to 4 inches high and are positioned far enough apart from each other to permit the fork members of a fork lift truck to be slipped into the pallet 8. It is preferable that a row of the spacers 17 be positioned on each vertical dividing plane 7 to form sturdy pallets 8 for each container 5 or 6 after the package is divided. However, the spacers 17 can be placed in rows on both sides of the vertical dividing plane 7, in which case the spacers 17 do not have to be made of low tear strength material since they will not be cut by the band 9.

Conventional kraft linerboard honeycomb spacers are constructed from a plurality of sheets corrugated into a continuous line of half-hexagonal shapes with the flat surfaces on each side of the sheet glued to the flat surfaces of another sheet. The resulting product has rows of hexagonal shapes with a glue line plane extending through the middle of each row. This construction of the spacers permits easy division of the spacers when they are positioned on the vertical dividing plane, as they are in the preferred embodiments. By aligning the glue line planes parallel with the vertical dividing plane 7, the band 9 can be pulled through a glue line plane and not have to cut the linerboard in the spacers 17. It is not even necessary for a glue line plane to be exactly in the vertical dividing plane, because the band 9 will shift over into the glue line plane when it meets the cutting resistance of the linerboard in the spacers 17.

Band 9 is preferably provided by a thin steel wire having a size from about 18 gauge to about 15 gauge. It can be made from other metals or even nonmetals, as long as it has adequate tensile strength to cut the pallet. A tensile strength of about 150 pounds or greater is satisfactory for the preferred pallet construction.

The following is an example of how the package of the invention can be advantageously used. A package like that illustrated in FIG. 1 is shipped from the manufacturer's facilities to a distributing warehouse, during which shipment the package will be loaded and unloaded with a fork lift truck using no other load supporting structure than pallet 8 of the package. The package is then transported intact from the warehouse to the retail store, where it is placed in backroom storage. There, a simple tug on the band 9 by hand or with the aid of any ordinary tool found around the storeroom cuts the pallet 8 into two sections, forming two separate palletized containers 5 and 6. The stock clerk can then insert a forked hand truck into one of the containers and wheel the container 5 or 6 into the display/sales area where the containers 5 or 6 is left after removing the front wall. The merchandise within the container 5 or 6 is then removed by the consumer. When the container is empty, it can be sold for scrap value or thrown away since it is inexpensive enough not to require pallet return.

The preferred embodiment of the invention has been described, but a number of variations within the scope of the invention will be obvious to one skilled in the art. For example, the material from which the containers 5 and 6 and the pallet 8 are constructed does not have to be corrugated boxboard. It could be any other inexpensive material which is sufficiently strong to permit shipping of the package, sufficiently cutable to be divided by band 9, and sufficiently inexpensive to permit disposal after use. In some case, it might be desirable to make the pallet in part or entirely out of rigid foam material, such as styrofoam. An example of such construction might be the use of styrofoam spacers rather than honeycomb kraft linerboard. Additionally, it is not necessary for the pallet 8 to form the only bottom wall of the containers 5 and 6, as illustrated in FIGS. 1 and 3. The containers could be provided by regular slotted containers (RSC) or half slotted containers (HSC) already having bottom walls, in which case the bottom wall of the boxes could be glued or stapled to the pallet 8. However, there is a saving in materials by employing the pallet 8 as the bottom for the containers 5 and 6, and it is therefore preferable. It should also be clear that the cap 14 does not have to provide the only top to the containers 5 and 6.

While the invention has been described in its preferred form as including only two containers 5 and 6, it should be obvious that more than two containers could be provided, with a vertical dividing plane separating each group of containers to be divided into separate packages, and a high tensile strength band 9 encircling the pallet 8 in each of the vertical dividing planes 7. An example of a package dividable into more than two containers would be a package of four equal size containers placed to form two perpendicularly intersecting vertical dividing planes. In this example, one of the high tensile strength bands 9 would preferably be placed over the other high tensile strength band 9 where the two vertical dividing planes intersect. It would be necessary to pull the inner band 9 before pulling the outer high band 9.

Figure 2:
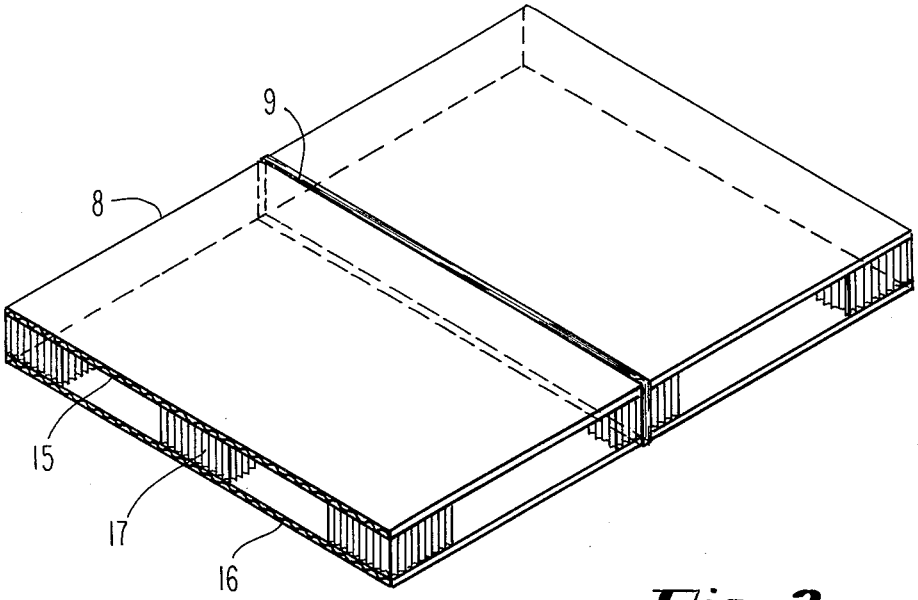
FIG. 2 is a perspective view of the dividable pallet of the invention employed in the dividable transport package of the invention.

The dividable pallet of the invention, illustrated in FIG. 2, can be used for purposes other than for the package of the invention. For example, one or more objects can be placed on each side of a vertical dividing plane 7 of the pallet and, upon pulling the band 9 and cutting the pallet, two or more separate pallets are formed, each supporting one or more objects.

Having described the invention, I claim:

1. A dividable transport package comprising:

A. at least two containers in side-by-side relationship on opposite sides of a vertical dividing plane; and B. a single pallet upon which both containers are secured to form the bottom of the package, the pallet comprising a continuous-plane platform of low tear strength material which supports all of the containers in the package and a thin band of high tensile strength material encircling the pallet in the vertical dividing plane for dividing the pallet into separate package upon pulling the band.

2. Package according to claim 1, wherein the pallet forms the only bottom wall of the containers.

3. Package according to claim 1, further including a single removable cap member which fits over both containers to secure the containers to each other at the top of the package.

4. Package according to claim 3, wherein the cap member forms the only top wall of the container.

5. Package according to claim 1, wherein the pallet material is corrugated boxboard, and the band is made from steel wire.

6. Package according to claim 1, wherein the pallet is made from corrugated boxboard sheets spaced apart from each other from kraft linerboard honeycomb spacers.

7. Package according to claim 6, wherein some of the spacers are arranged adjacent to and on both sides of the vertical dividing plane to permit the band to cut through the pallet without passing through a spacer.

8. Package according to claim 6, wherein a row of the spacers is positioned on the vertical dividing plane and the spacers in the row have vertical glue line planes extending through the glue line of the spacers without passing through the linerboard and positioned parallel with the vertical dividing plane.

9. Packaged according to claim 1, wherein each container is formed by a back wall, two side walls and a front wall which faces the other container, the back walls and two side walls extending beyond the front wall to overlap and be attached to the edges of the pallet.

10. A dividable transport pallet comprising;

a. a continuous-plane of low tear strength material having an upper surface for supporting two or more objects in side-by-side relationship on opposite sides of a dividing plane which is normal to the continuous plane of the low-tear strength material; and b. a thin band of high tensile strength material encircling said pallet in the dividing plane of the low-tear strength material to divide said pallet into separate pallets, each of said separate pallets supporting one or more objects thereon when said band is pulled through said dividable pallet.

* * * * *

PO-1050
(5/69)

UNITED STATES PATENT OFFICE
CERTIFICATE OF CORRECTION

Patent No. 3,993,191 Dated November 23, 1976

Inventor(s) John N. Membrino

It is certified that error appears in the above-identified patent and that said Letters Patent are hereby corrected as shown below:

Column 1, line 14, change "form" to --from--;
Column 1, line 58, add --and-- between Patent Nos. "3,157,423 3,650,224";
Column 1, line 59, change "pellet" to --pallet--;
Column 4, line 24, change "containers" to --container--;
Column 6, line 3, delete "from" second occurrence and substitute therefor --with--;
Column 6, line 15, change "Packaged" to --Package--.

Signed and Sealed this
First Day of March 1977

[SEAL]

*Attest:*

RUTH C. MASON
*Attesting Officer*

C. MARSHALL DANN
*Commissioner of Patents and Trademarks*